US006848127B2

(12) United States Patent
Inagaki

(10) Patent No.: US 6,848,127 B2
(45) Date of Patent: Feb. 1, 2005

(54) FOLDING SOFA BED

(75) Inventor: Kenichi Inagaki, Hamamatsu (JP)

(73) Assignee: Maruhachi-Mawata Co., Ltd., Hamamatsu (JP)

( * ) Notice: Subject to any disclaimer, the term of this patent is extended or adjusted under 35 U.S.C. 154(b) by 0 days.

(21) Appl. No.: 10/138,981

(22) Filed: May 2, 2002

(65) Prior Publication Data

US 2003/0167566 A1 Sep. 11, 2003

(30) Foreign Application Priority Data

Mar. 6, 2002 (JP) ..... 2002-061140

(51) Int. Cl.[7] ..... A47C 17/04
(52) U.S. Cl. ..... 5/18.1; 5/12.1; 5/17; 5/58
(58) Field of Search ..... 5/18.1, 58, 17, 5/37.1

(56) References Cited

U.S. PATENT DOCUMENTS

| | | | | | |
|---|---|---|---|---|---|
| 758,580 | A | * | 4/1904 | Gross | 81/113 |
| 1,354,540 | A | * | 10/1920 | Dixon | 5/42.1 |
| 2,120,663 | A | * | 6/1938 | Bowersox et al. | 5/18.1 |
| 2,329,914 | A | * | 9/1943 | Kost | 5/39 |
| 4,402,096 | A | * | 9/1983 | Atimichuk | 5/17 |
| 4,601,074 | A | | 7/1986 | Welsch et al. | |
| 4,672,696 | A | * | 6/1987 | Horenkamp | 5/17 |

FOREIGN PATENT DOCUMENTS

| | | |
|---|---|---|
| CA | 1160003 | 10/1984 |
| DE | 866 834 | 2/1953 |
| DE | 87 16 255 | 3/1988 |
| DE | 200 13 675 | 12/2000 |
| JP | 57-39809 | 5/1982 |
| JP | 8-242973 | 9/1996 |

* cited by examiner

*Primary Examiner*—Teri Pham Luu
(74) *Attorney, Agent, or Firm*—Kolisch Hartwell, P.C.

(57) ABSTRACT

The invention aims to provide a folding sofa bed wherein a sofa can be made compact and which gives a stable bed that is comfortable to sleep on, and moreover where converting between a sofa and a bed is very easy. The folding sofa bed of the invention comprises a mat section divided lengthwise into three parts, namely a front mat, a center mat and a rear mat, a support frame for supporting part of the rear mat and center mat, and a movable storage container which supports the rest of the center mat and most of the front mat. Furthermore, each mat is secured to an upper edge of the support frame or the movable container, so as to be rotatable up and down, and the movable container can be stored within the support frame.

11 Claims, 11 Drawing Sheets

FOLDING SOFA BED

BACKGROUND OF THE INVENTION

1. Field of the Invention

The present invention relates to a folding sofa bed, and relates specifically to a folding sofa bed which can easily be used as either a sofa or a bed by simply pushing in or pulling out a movable storage container which can also be used for storing objects.

2. Description of the Background Art

Many different forms have been proposed for sofa beds usable as both a sofa and a bed. The functions desired in such sofa beds are that the sofa bed has sufficient surface area when used as a bed, and folds into as small a size as possible to conserve space when not used as a bed, and that the sofa bed is stable when a bed and comfortable to sit on when in sofa form. In order to provide a sofa bed with these functions, a construction wherein the sofa bed is compact as a whole, and where changing between a sofa and a bed is simple and requires little effort is desired.

As an example of such a folding sofa bed, there is disclosed in Japanese Unexamined Patent Application, First Publication No. Hei 8-242973, a folding sofa bed wherein a mat is divided into three parts, with a front end of a center mat and a rear end of a front mat connected so as to freely rotate up and down, a rear end of the center mat and a front end of a rear mat connected by a connecting member which latches at least when substantially at right angles and when horizontal, and a front end of the front mat and a front upper edge of a base connected so as to freely rotate up and down, and wherein legs and casters are provided on the bottom surface of the rear mat.

Although this folding sofa bed becomes a compact sofa because the mat section is divided into three parts, the support of the center mat and the rear mat when used as a bed is at two points, one at each end of the mats, and is thus unstable, and the middle part of each mat tends to sag, making the bed uncomfortable to sleep on. Furthermore, although there is space underneath the rear mat, this space cannot easily be used for storage.

Furthermore, in Japanese Unexamined Patent Application, First Publication No. Sho 57-39809, there is disclosed a sofa bed wherein a mat is divided into three parts, with a front end of a center mat and a rear end of a front mat connected so as to freely rotate up and down, a rear end of the center mat and a front end of a rear mat also connected so as to freely rotate up and down, and with one end of the center mat supported by a support frame of the sofa body, the other end of the center mat supported by a movable support member, a rear end of the center mat and a front end of the rear mat connected by a connecting member which latches at least when substantially at right angles and when horizontal, and a front end of the front mat and a front upper edge of a movable support member connected so as to freely rotate up and down. In addition, casters are provided on the bottom surface of the movable support member, and the movable support member can be stored within the support frame.

Although the folding sofa bed with this construction becomes a compact sofa because the mat section is divided into three parts, there is the disadvantage that support of the center mat when used as a bed is at two points, one at each end of the mat, and is thus unstable, and the middle part of the center mat tends to sag, making the bed uncomfortable to sleep on. Furthermore, when converting between a sofa and a bed, a problem occurs in that the casters do not slide along the floor well, and the conversion operation cannot be performed smoothly.

The present invention aims to solve the above problems, by providing a new construction for a folding sofa bed wherein the sofa is made compact by dividing the mat section into three parts, and when used as a bed, each mat is supported across its entire area and is stable, resulting in a bed that is comfortable to sleep on because instability caused by sagging of the central part of the mat does not occur. Moreover converting between a sofa and a bed is easy, and the sofa bed can be used as a storage container in a user friendly manner.

SUMMARY OF THE INVENTION

In order to solve the above problems, a folding sofa bed of the present invention comprises a mat section divided lengthwise into at least three parts, namely a front mat, a center mat and a rear mat, a support frame for supporting part of the rear mat and center mat, and a movable storage container which supports the rest of the center mat and most of the front mat, wherein one end of the rear mat and one end of the center mat are foldably connected, and a front end of the rear mat is supported so as to be rotatable up and down by a front of the support frame, an other end of the center mat is supported so as to be rotatable up and down by the movable storage container, and one end of the front mat is supported so as to be rotatable up and down by the movable storage container, and by employing a construction wherein the movable storage container is stored within the support frame, when the movable storage container is stored within the support frame, the rear mat and center mat fold into an inverse V-shape to form a backrest, and the front mat becomes a seat thus forming the sofa, and when the movable container is pulled out from within the support frame, the front mat, center mat and rear mat become a continuous flat surface thus forming the mat section.

By employing the above construction, when the sofa bed is used as a bed, because the center mat is supported across the whole area thereof by the top edge of the support frame and the movable storage container, the bed does not sag in the center and is very stable and comfortable to sleep on.

Furthermore, because conversion between a bed and a sofa is very easily accomplished, and the sofa bed can also be used as a storage container, the sofa bed is well suited for use as multifunctional furniture that is suitable for use in small dwellings.

Preferably the construction of the folding sofa bed of the present invention is such that when in bed form, approximately half of the center mat is supported by the support frame, and the remainder of the center mat is supported by the movable storage container.

By employing such a construction, well balanced support of the center mat can be ensured. Therefore when used as a bed the center of the center mat does not sag, enabling a bed is thus very stable and comfortable to sleep on.

Furthermore, preferably the construction of the folding sofa bed of the present invention is such that wheels are provided on four corners of the bottom of the movable storage container, and rails for guiding the wheels are provided on the bottom of both sides of the support frame, and the movable storage container is movable by moving the wheels on the four corners of the bottom of the movable container back and forth upon these rails.

Moreover, preferably a support portion of the rear mat of the mat section supported on the support frame, a junction between the rear mat and the center mat, a support portion of the rear mat supported on the movable storage container, and a support portion of the front mat supported on the movable storage container are each connected or supported using spring loaded buffers.

According to such a construction, converting the sofa bed between a sofa and a bed is very easy, and even children and the elderly can easily perform the conversion. Therefore it is possible to rearrange a room according to need.

Furthermore, in the folding sofa bed of the present invention, preferably a removable connector is used at the junction connecting the rear mat and the center mat of the mat section.

According to such a construction, dismantling and assembling the sofa bed is very easy and can be performed by anyone, making it possible for the sofa bed to be used by a wide range of people.

Furthermore, preferably in the foldable sofa bed of the present invention, the total length of the movable container is approximately half the length of the bed.

This is so that the center mat of the bed can be stably supported, and so that the sofa is as compact as possible, so as to not waste any space in a small room.

Furthermore, preferably when the foldable sofa bed of the present invention is used as a sofa, the front mat is supported by the movable storage container in such a way that the front mat can open upward from the front of the sofa.

This is so that the folding sofa bed of the present invention is easy to use as a storage container, and can be fully utilized as a piece of multifunctional furniture.

DETAILED DESCRIPTION OF THE PREFERRED EMBODIMENTS

Figure 1:
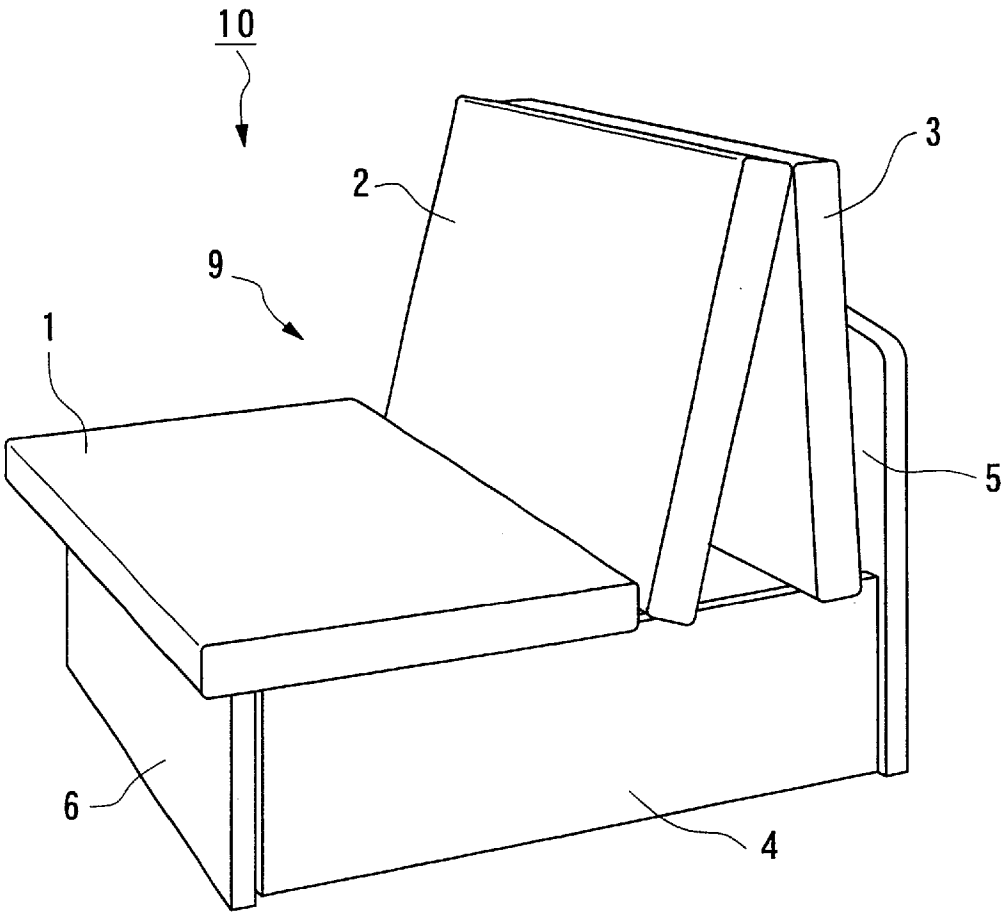
FIG. 1 is an external view of a folding sofa bed of the present invention when folded into a sofa.

As follows is a description of the construction and functions of the folding sofa bed of the present invention with reference to the drawings. Moreover, hereunder in the drawings, in order to simplify the description of each function, the respective members are not necessarily drawn exactly to scale.

FIG. 1 through FIG. 4 show external views of the process of converting the folding sofa bed of the present invention from a sofa to a bed.

FIG. 1 is an external view of a folding sofa bed 10 of the present invention when folded into a sofa. A state is shown where the movable storage container is stored within a support frame 4, and only a front panel 6 of the movable storage container is visible and the sofa bed is in its most compact state. Of the three parts which form a mat section 9, a center mat 2 and a rear mat 3 are folded into an inverse V-shape to form a backrest, and a front mat 1 is supported by the support frame 4 and a movable storage container 8 (central in the figure but not visible) to form the seat of the sofa. In FIG. 1, a backboard 5 for use when the sofa bed is in bed form is mounted behind the rear mat 3 which forms the backrest.

Figure 2:
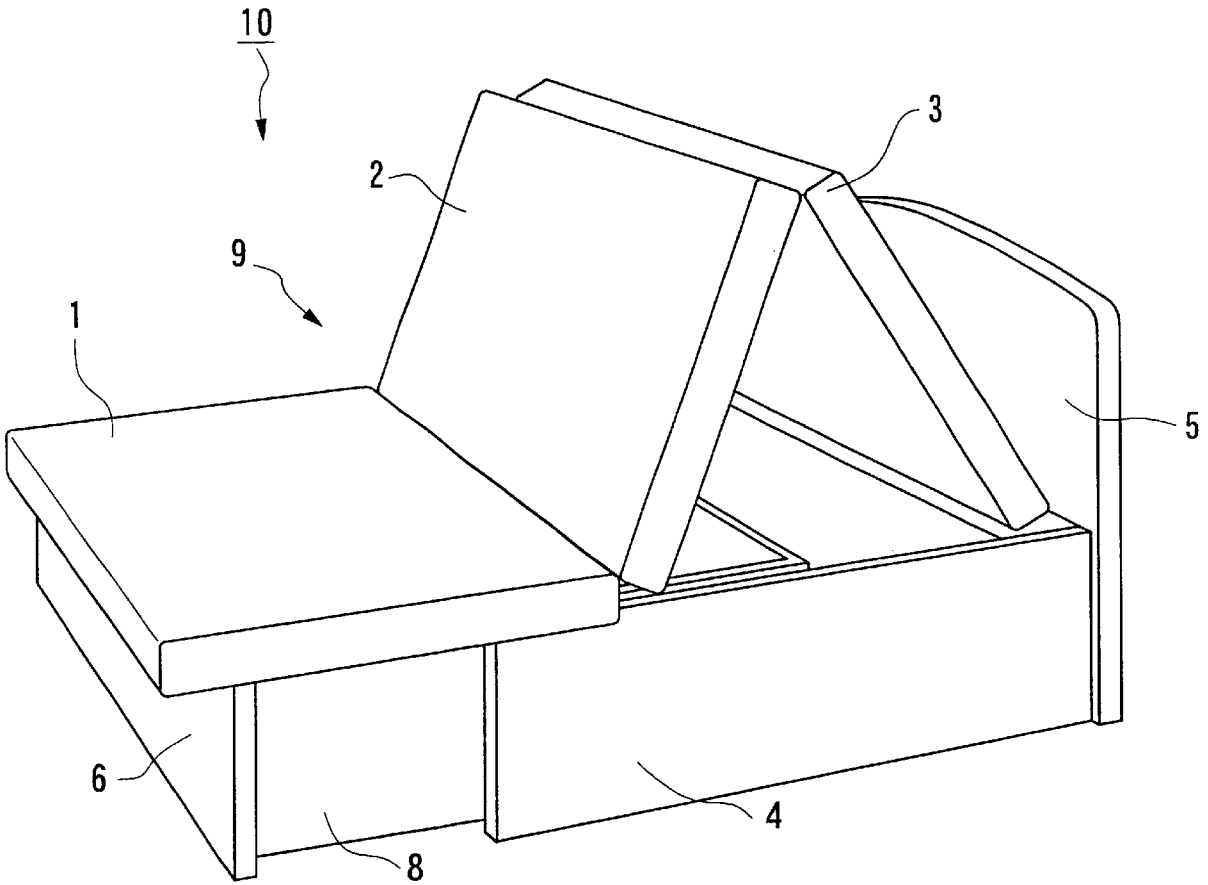
FIG. 2 is an external view of an initial step in converting the folding sofa bed of the present invention to a bed.

FIG. 2 is an external view showing a state immediately after starting the operation of converting the sofa bed from a sofa to a bed. By pulling the movable storage container 8 out from within the support frame 4, the center mat 2 and the rear mat 3 which fold into a V-shape to form the backrest of the sofa gradually move apart and start to lower.

Figure 3:
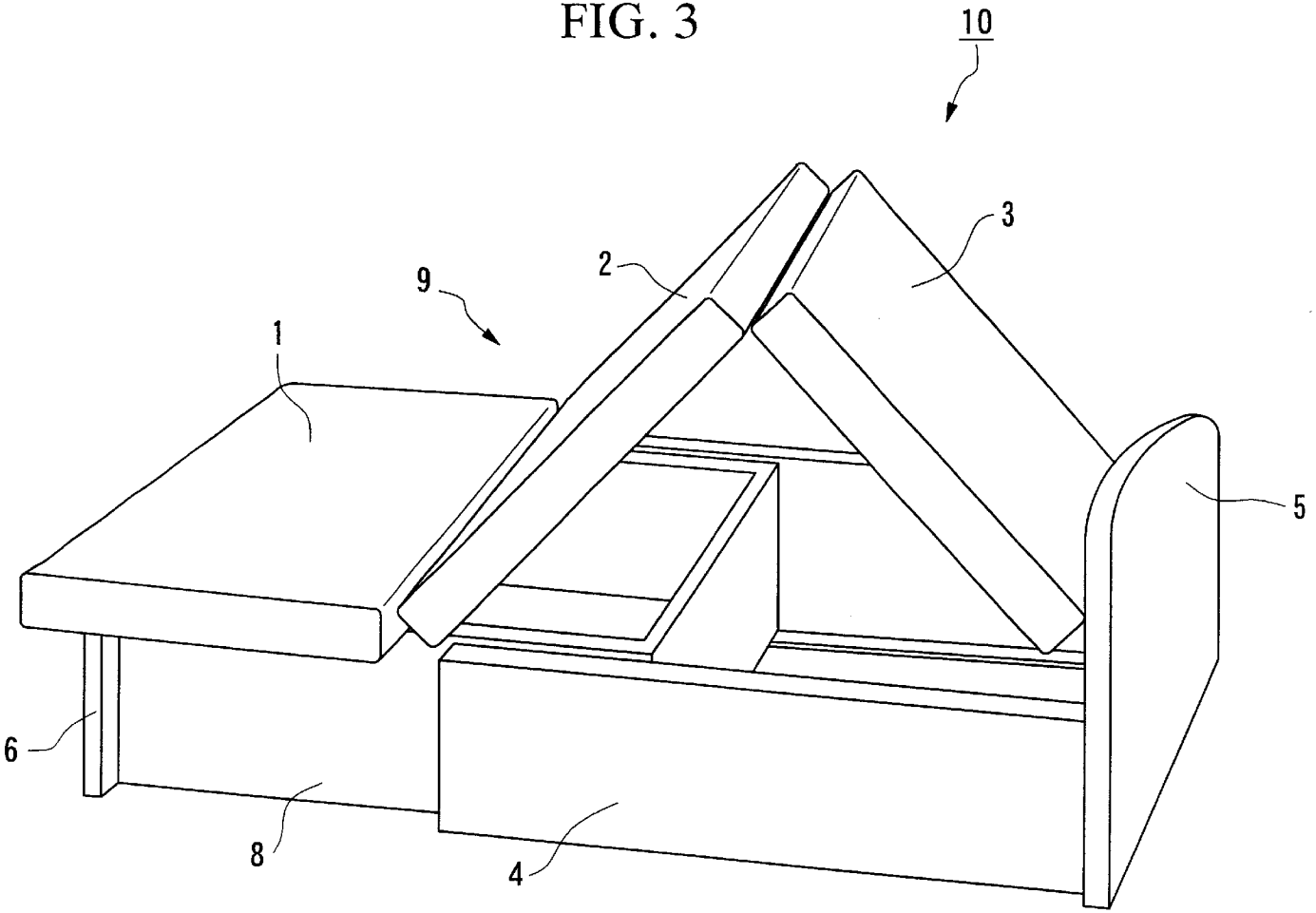
FIG. 3 is an external view of a final step in converting the folding sofa bed of the present invention to a bed.

FIG. 3 is an external view showing a state where the conversion operation from a sofa to a bed has progressed further, viewed from a different angle from that in FIG. 2. When the movable storage container 8 is pulled out further from within the support frame 4, the center mat 2 and the rear mat 3 which are folded into a V-shape to form the backrest of the sofa move further apart and become even lower. It can be seen here that the movable storage container 8 is box shaped, and items can be stored therein.

Figure 4:
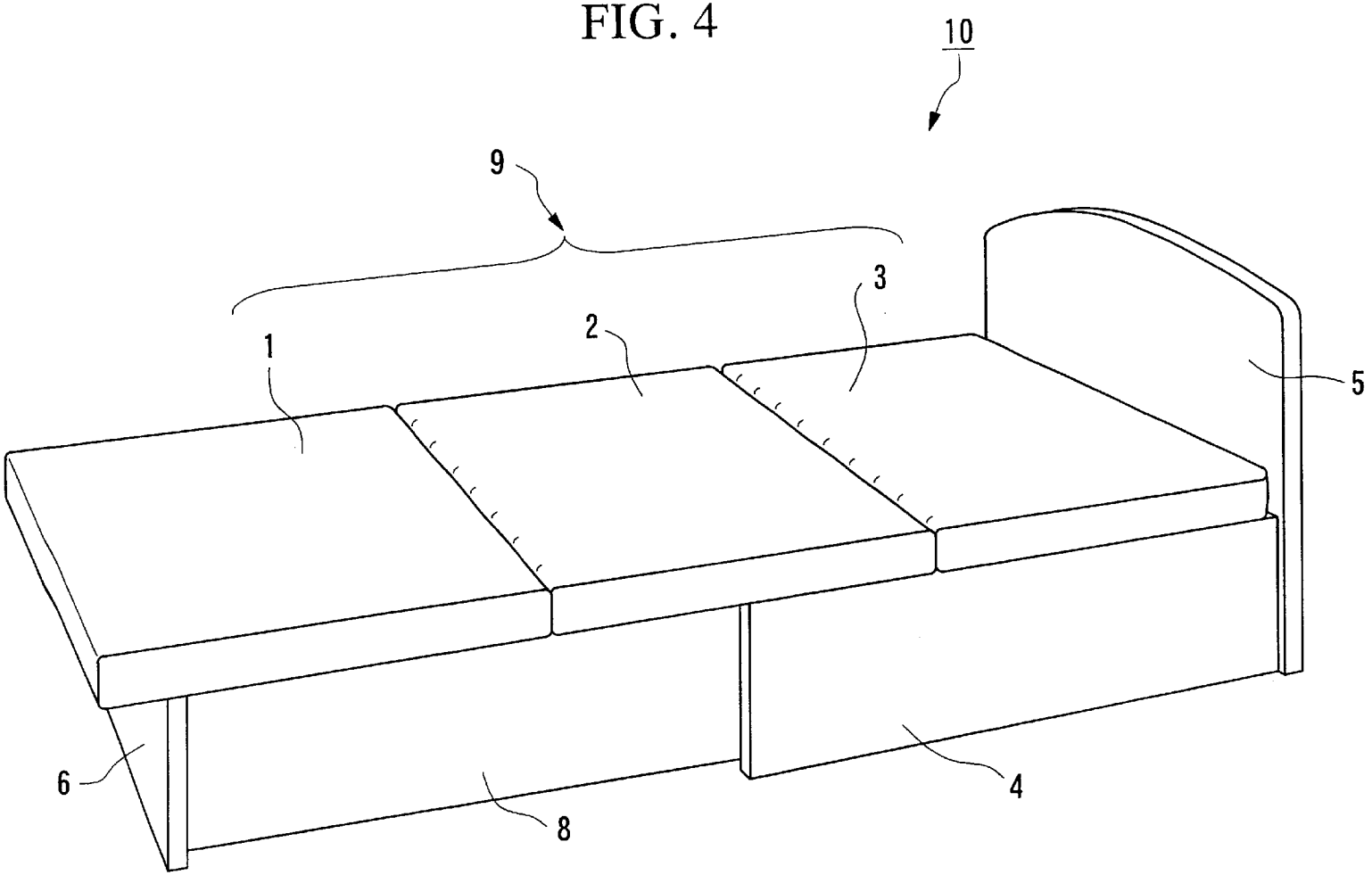
FIG. 4 is an external view of the folding sofa bed of the present invention when used as a bed.

FIG. 4 is an external view showing a state where the movable storage container 8 is pulled out from within the support frame 4, and the operation of converting from a sofa to a bed is completed and the sofa bed is in bed form.

As shown in FIG. 4, the front mat 1, the center mat 2 and the rear mat 3 extend horizontally to form a single continuous mat section 9. Approximately half of the center mat 2 is supported by the support frame 4, and the remainder is supported by the movable storage container 8. Because the entire area of the center mat 2 is supported from underneath in this manner, the center does not sag like in conventional beds, and the bed is very stable and comfortable to sleep on.

Next, in FIG. 5 through FIG. 12, the construction of each part of the folding sofa bed of the present invention is described sequentially in detail.

Figure 5:
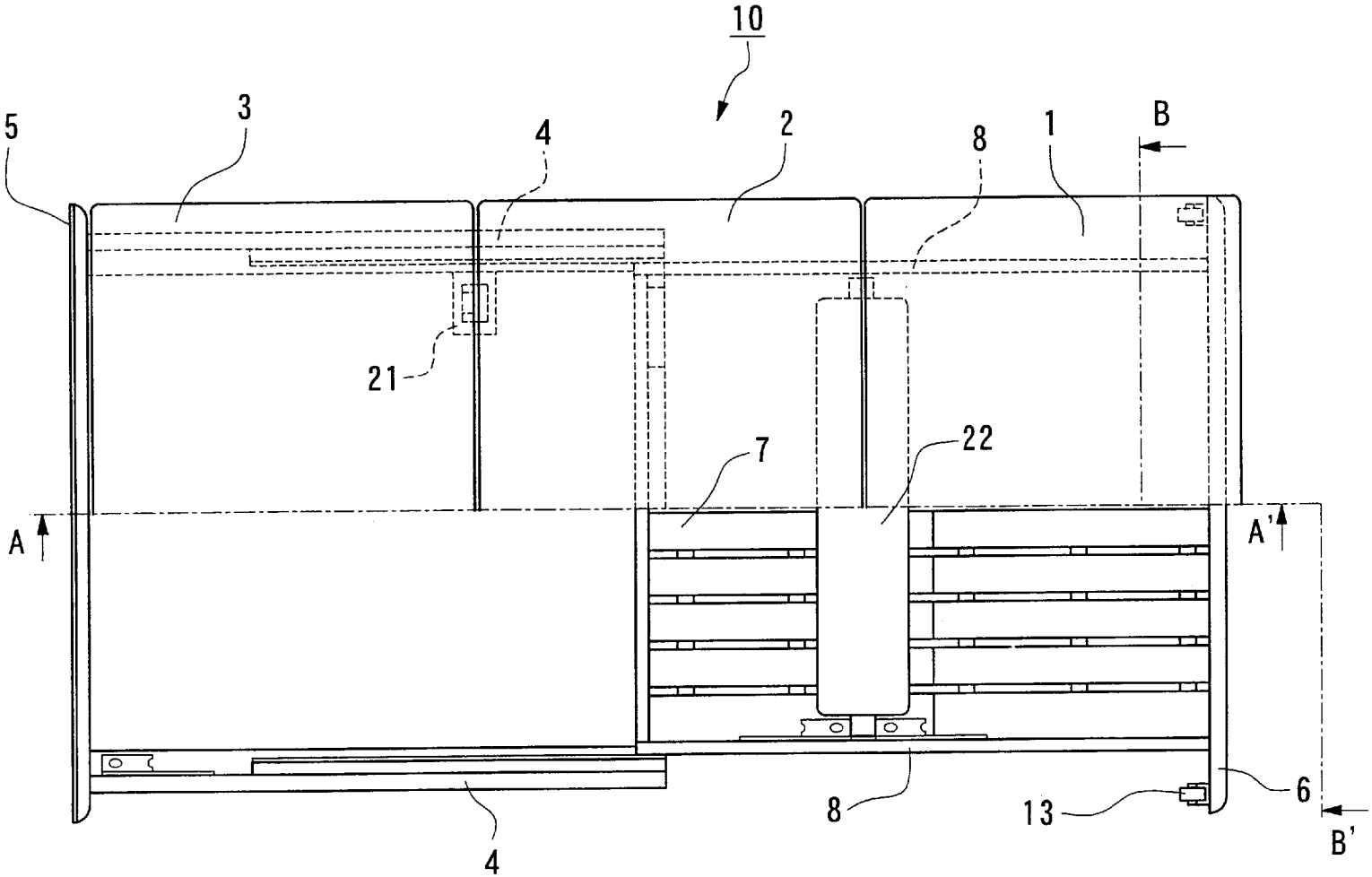
FIG. 5 is a partial cut away plan view of the folding sofa bed of the present invention when used as a bed.

FIG. 5 is a partial cut away plan view of the folding sofa bed of the present invention in bed form.

As shown in the figure, the support frames 4 are disposed on both sides of the bed in the width direction, and the movable storage container 8 fits within these support frames 4. To use the sofa bed as a bed, the movable storage container 8 is pulled out from within the support frames 4, and the front mat 1, the center mat 2 and the rear mat 3 line up on top of the support frames 4 and the movable storage container 8 to form the bed. Because the support frames 4 and the movable storage container 8 are underneath the center mat 2, the whole area of the center mat 2 is supported, improving stability and comfort.

Furthermore, it is preferable that the total length of the movable container 8 be approximately half the length of the bed. This is so that the entire area of the center mat 2 is supported by the movable storage container 8 as described above, and so that when used as a sofa, the sofa bed is as compact as possible.

In the lower half of FIG. 5, half of each of the three mats is cut away to reveal the inside of the sofa bed. On the left side of the page near the backboard 5 is the space in which the movable storage container 8 is stored when in sofa form. Movable storage container bottom panels 7 extend in slat form along the movable storage container 8 shown on the right side of the page. Of course, the movable storage container bottom panels 7 may be of a solid construction. Near the center of the movable storage container 8 is a dock board 22 for securing the center mat 2 and the front mat 1. Furthermore, a removable connector 21 is used in the junction connecting the front mat 1 and the center mat 2. The removable connector 21 uses a hinging method wherein a hinge is assembled via a shaft after the front mat 2 and the rear mat 3 are assembled. By using the removable connector 21, assembly and disassembly can be performed easily.

Figure 6:
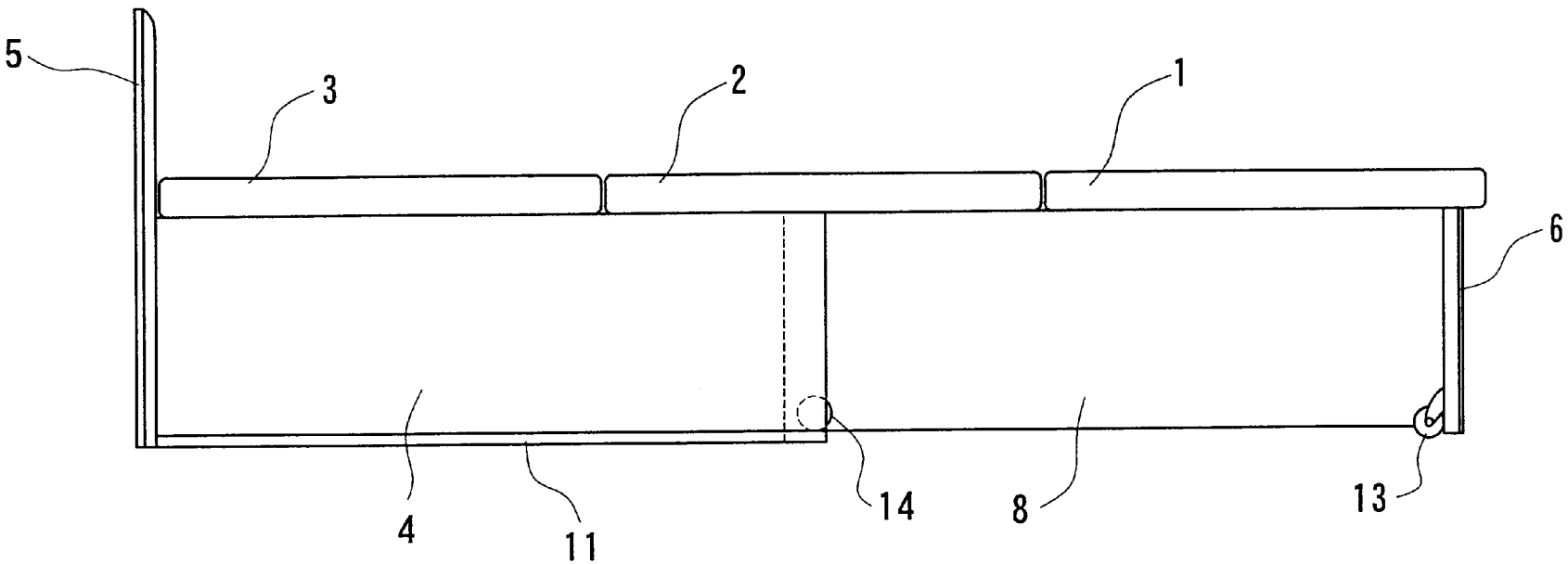
FIG. 6 is a side view of the folding sofa bed of the present invention.

FIG. 6 is a side view of the folding sofa bed of the present invention in bed form. As shown in the figure, the support frame 4 and the movable storage container 8 extend in succession, and the front mat 1, the center mat 2 and the rear mat 3 line up horizontally upon the top edge thereof to form a bed.

A front wheel 13 and a rear wheel 14 are mounted on the bottom of the movable storage container 8. The front wheel 13 travels along the floor of the room, while the rear wheel 14 travels along a rail 11 mounted on the bottom of the support frame 4. Consequently, the movement when pulling out and when storing the movable storage container 8 is smooth, and the operation of converting the sofa bed between a sofa and a bed is easy.

Figure 7:
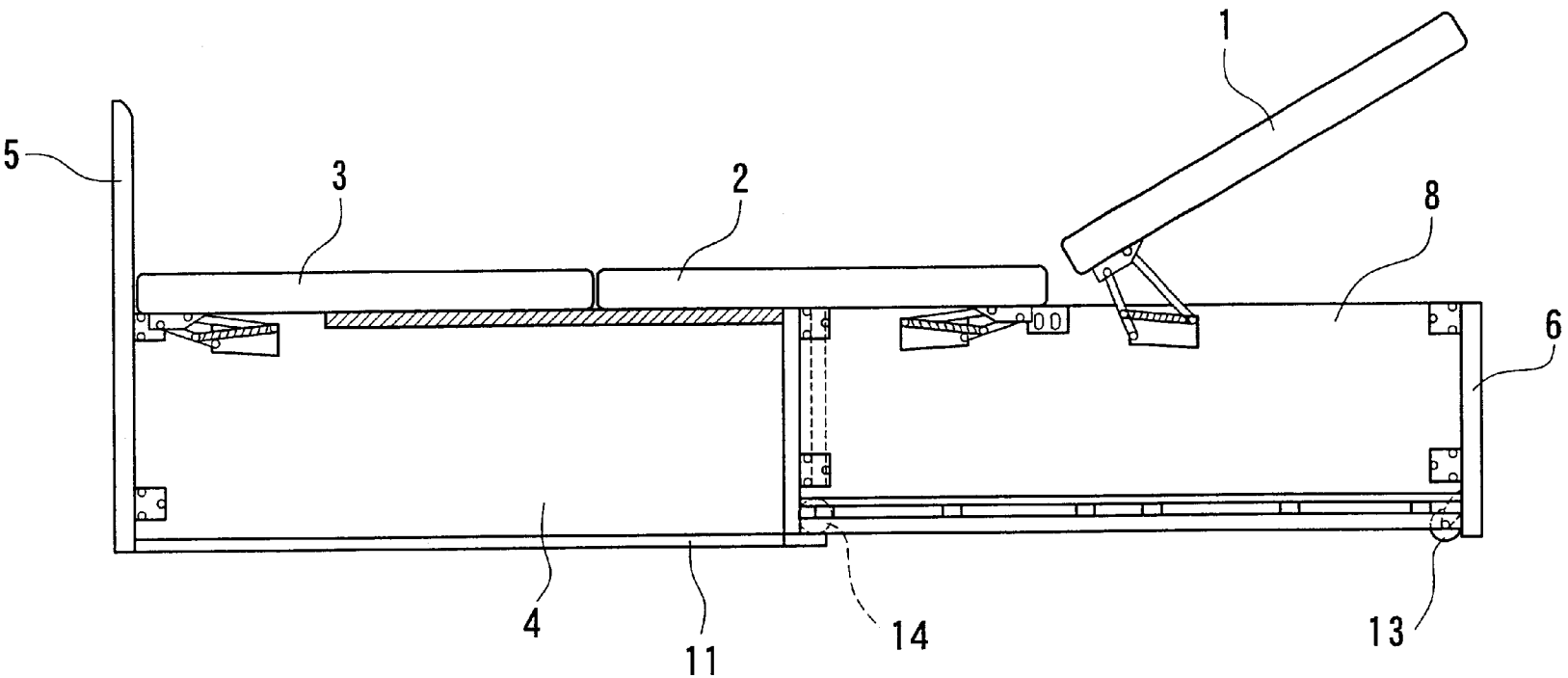
FIG. 7 is a cut away side view along the line A-A' of the folding sofa bed of the present invention.

FIG. 7 is a cut away side view along the line A-A' shown in FIG. 5, of the folding sofa bed of the present invention.

FIG. 7 mainly shows the method used to mount the front mat 1, the center mat 2 and the rear mat 3 to the support frame 4 and the movable storage container 8. To mount each mat to the support frame 4 or the movable storage container 8, spring loaded buffers 15, 16 and 17 are used. Because these buffers 15, 16 and 17 which function by two levers and a spring can be opened or closed by applying only a small amount of force, and because they will not collapse suddenly, the folding and the release of the front mat 1 and the center mat 2 can be performed smoothly. Furthermore, when placing items in or removing items from the movable storage container 8, it is possible to open or close the front mat 1, which also acts as the lid of the storage container, smoothly.

Preferably the front mat 1 is mounted facing in the direction shown in the figure, so that the front mat can open upward from the front of the sofa when the sofa bed is in sofa form. Even when the sofa bed is used as a sofa, the movable storage container 8 is convenient to use for storing small items when tidying a room.

Figure 8:
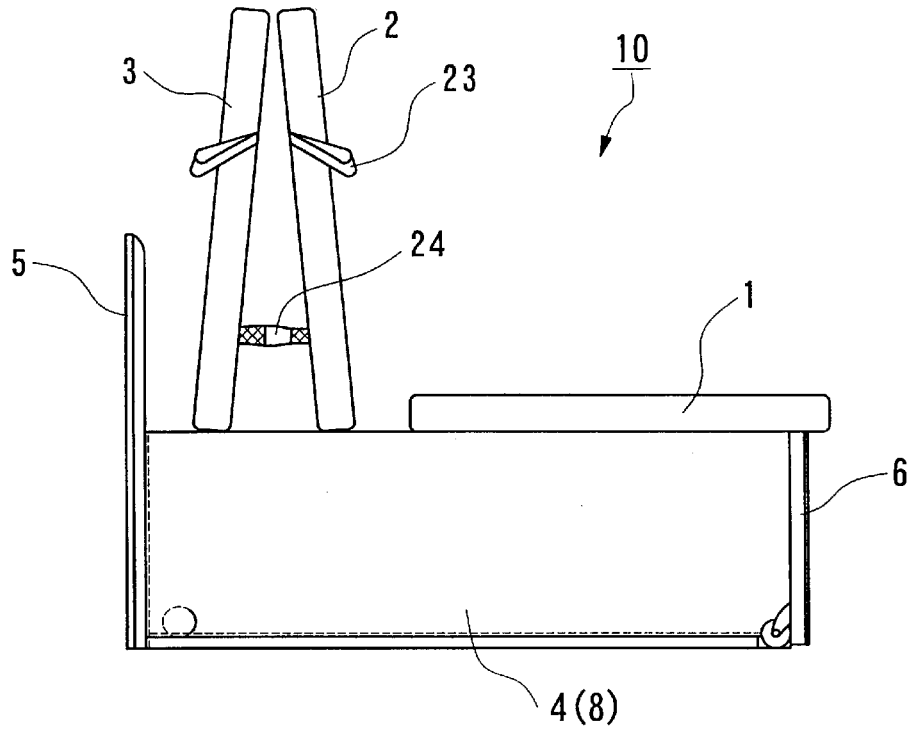
FIG. 8 is a side view of the folding sofa bed of the present invention when used as a sofa.

FIG. 8 is a side view of the folding sofa bed of the present invention in sofa form. As shown in the figure, in sofa form, the center mat 2 and the rear mat 3 are folded into an inverse V-shape to form the backrest, and the front mat lies flat across the top of the support frame 4 to form the seat of the sofa. Because the movable storage container 8 is stored inside the support frame 4, the sofa bed is very compact, allowing better use of the space in the room.

Figure 9:
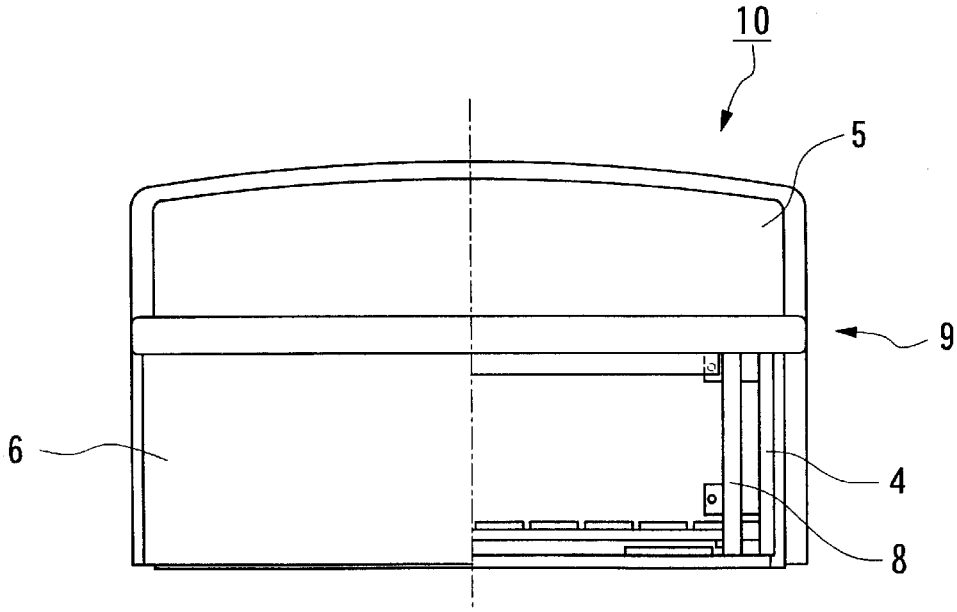
FIG. 9 is a partial cross-sectional view along the line in B-A'-B' of FIG. 5.

FIG. 9 is a partial cross-sectional view along the line B-A'-B' in FIG. 5, of the folding sofa bed of the present invention.

The left half of FIG. 9 is a front external view where only the front panel 6 of the movable storage container 8 can be seen. Furthermore, the right half of the figure is a cross-sectional view with the front panel 6 removed, which shows that the movable storage container 8 is stored inside the support frame 4.

Figure 10:
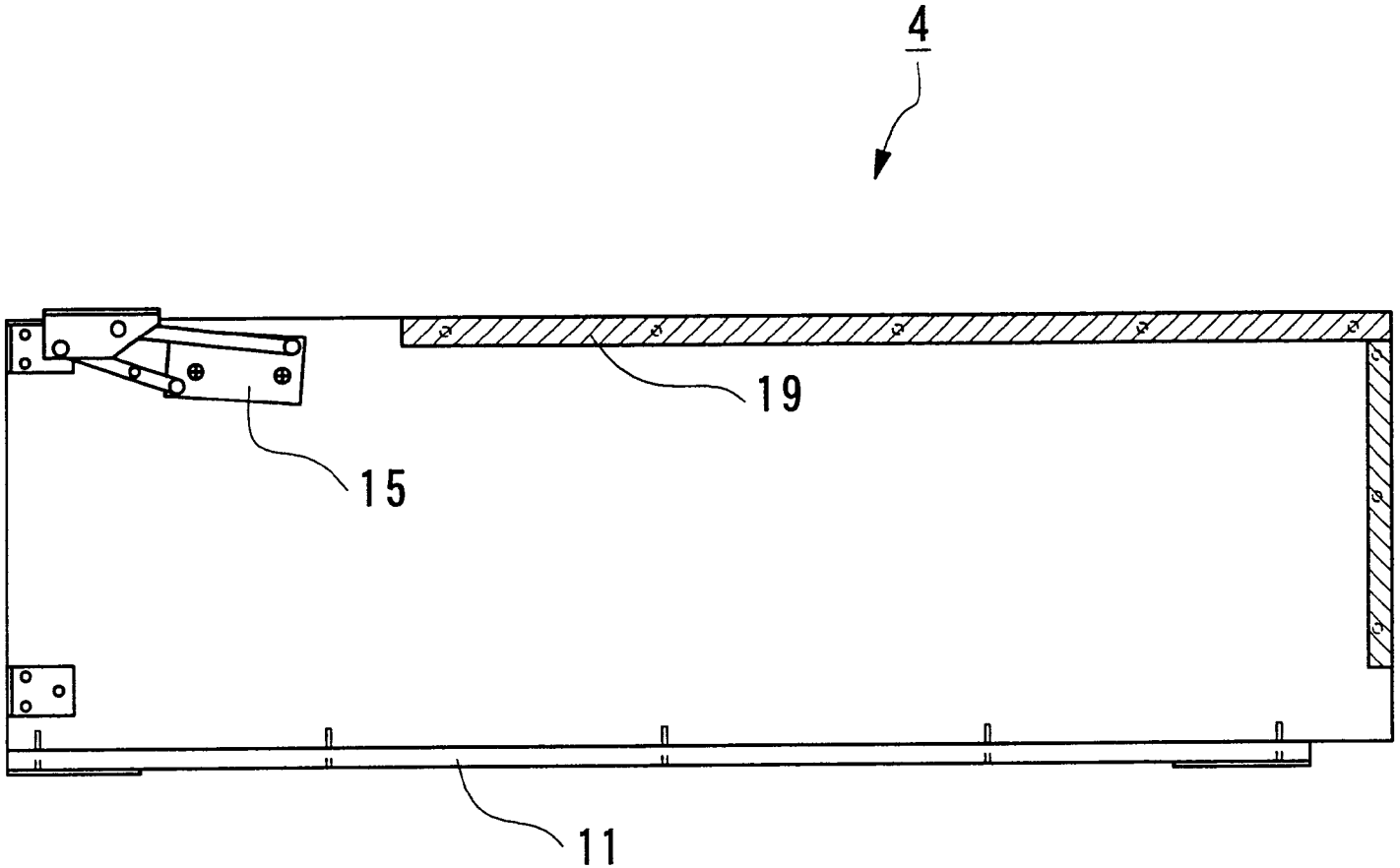
FIG. 10 is a view showing the construction of a support frame of the folding sofa bed of the present invention.

FIG. 10 is a working drawing showing in detail the construction of the inside of the support frame 4. In the upper left of the figure, the buffer 15 for mounting the rear mat 3 is mounted on a side panel of the support frame 4. Furthermore, on the top and on the right of the figure, side panel spacers 19 and 20 which are made from felt or the like for maintaining slidability with the movable storage container 8 are applied to the support frame 4.

A rail 11 for guiding the rear wheel is provided on the bottom of the side panel of the support frame 4. Furthermore, reinforcing metal fittings 12 are mounted at the corners of the support frame 4.

Figure 11:
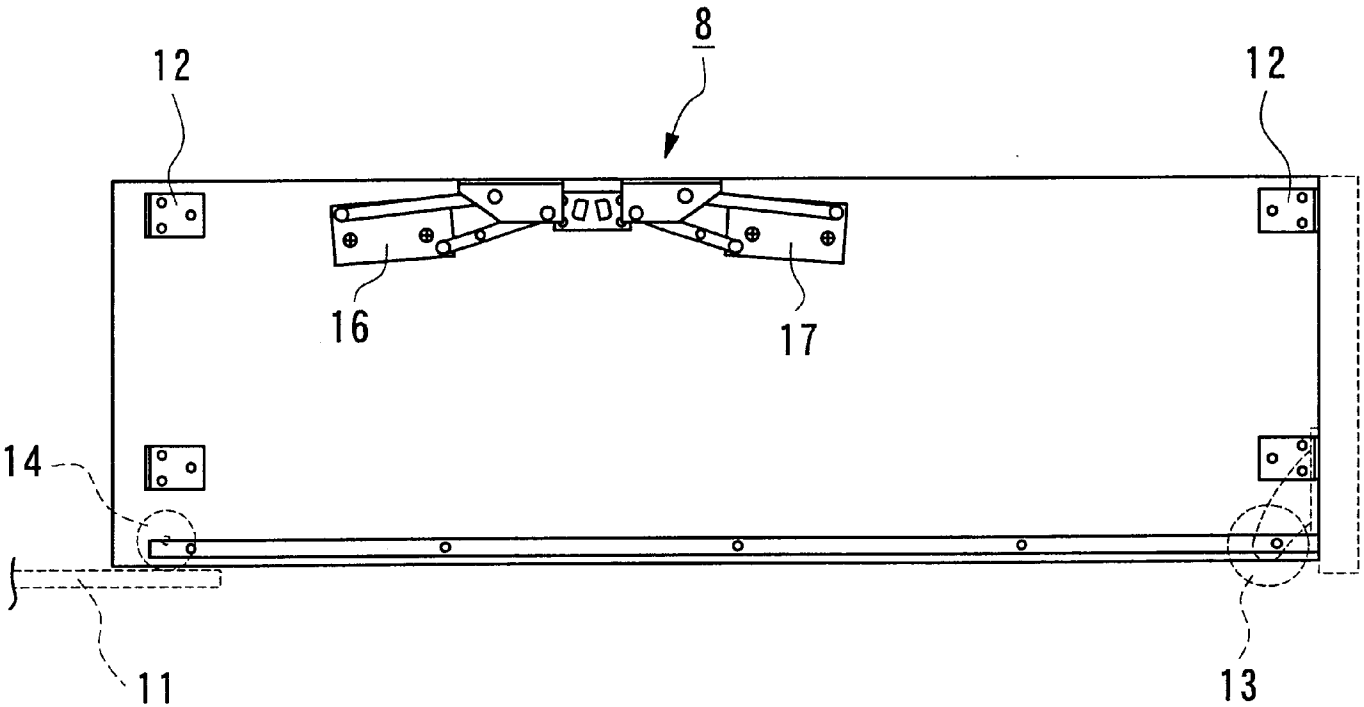
FIG. 11 is a view showing the construction of a movable storage container of the folding sofa bed of the present invention.

FIG. 11 shows in detail the construction of the movable storage container 8. Because the movable storage container 8 is box shaped, the reinforcing metal fittings 12 are mounted at the four corners thereof. The buffers 16 and 17 for securing the front mat 1 and the center mat 2 are mounted near the center of the movable storage container 8. Furthermore, the movable storage container bottom panel 7 is attached to the bottom of the movable storage container 8. In addition, the front wheel 13 is mounted to the rear of the front panel 6 of the movable storage container 8. The front wheel 13 is mounted at the same level as the floor of the room. Furthermore, the rear wheel 14 is mounted to the bottom of the far end of the movable storage container 8 as shown in the figure. The rear wheel 14 is mounted so as to sit on the rail on the bottom of the support frame 4.

Figure 12:
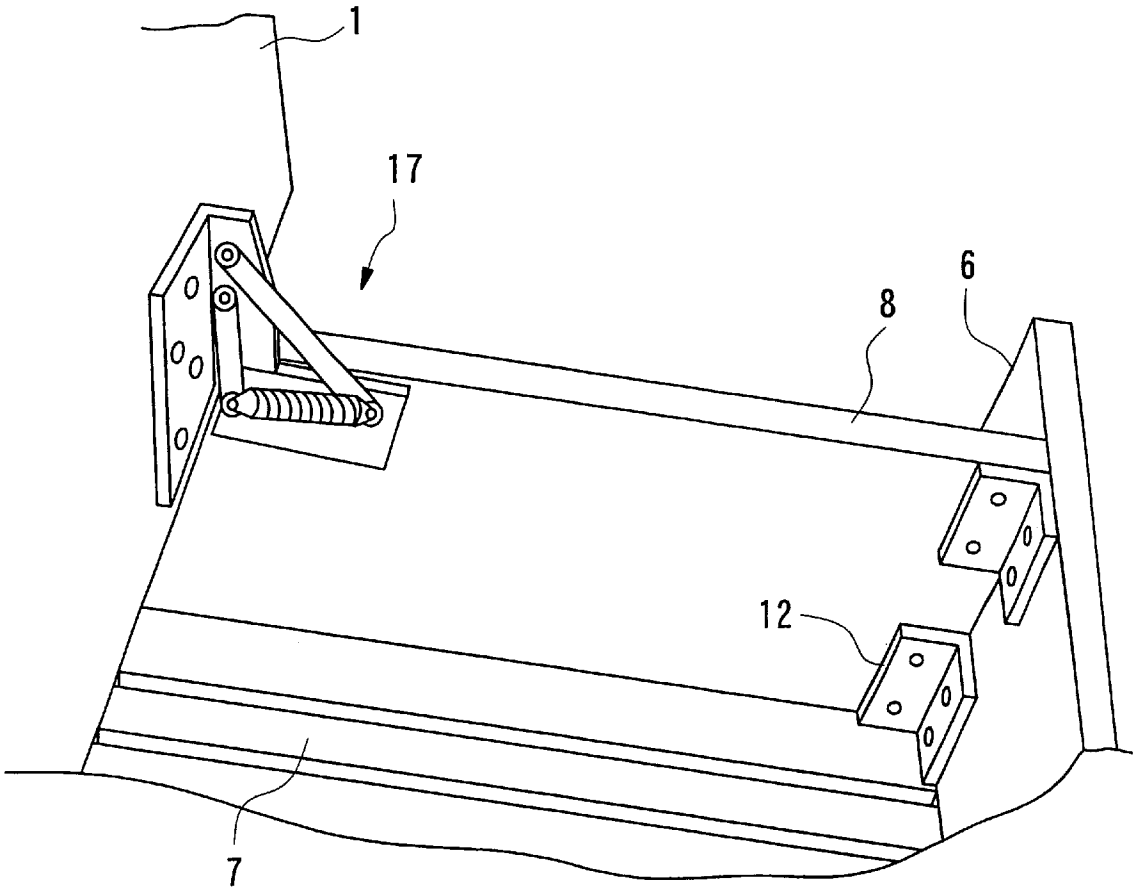
FIG. 12 is a view showing a mounting construction of a buffer of the movable storage container of the folding sofa bed of the present invention.

FIG. 12 shows the construction used to mount the buffer 17 to the movable storage container 8. The buffer 17 is mounted to the side panel of the movable storage container 8, and the front mat 1 is secured to this buffer 17. By securing the front mat 1 using the buffer 17 in this manner, the front mat 1 which also acts as the seat of the sofa can be opened and closed smoothly. The reinforcing metal fittings 12 are mounted at the corners of the movable storage container 8. Furthermore, in the example shown in this figure, the movable storage container bottom panel 7 of the movable storage container 8 forms slats as described above. The interior of the movable storage container 8 should be designed so that it can be used for storing objects when the sofa bed is in both bed form and sofa form. The movable storage container 8 should be strong in both sofa and bed form, and should function as a storage container and be easily movable.

Many improvements can be made to the folding sofa bed of the present invention to improve ease of use. For example, in the example shown in FIG. 1 through FIG. 4, except for the backboard 5 the support frame 4 is entirely underneath the mats, but it is possible to modify the support frame to include armrests. Alternatively, a pull handle could be mounted to the front panel 6 of the movable storage container 8 to simplify the operation of pulling out the movable storage container 8 to form the bed.

Furthermore, as shown in the views of the sofa in FIG. 8, a handle 23 for opening the center mat 2 and the rear mat 3, and a buckle 24 for latching together the center mat 2 and the rear mat 3 which form the backrest, are good examples of some of the accessories that can be used to make the folding sofa bed of the present invention even easier to use.

The folding sofa bed of the present invention allows the space in a room to be used efficiently. Furthermore, the mat section is divided into three parts to form a compact sofa, and when in bed form, the entire area of each mat is supported and is stable without sagging in the center, yielding a folding sofa bed that is stable and comfortable to sleep on, and is very easy to convert between a sofa and a bed. In addition, the folding sofa bed of the present invention is easily used as a storage container for storing items. In other words, the folding sofa bed of the present invention is well suited for use as multifunctional furniture that is suitable for use in small dwellings.

What is claimed is:

1. A folding sofa bed comprising: a mat section divided lengthwise into at least three parts, namely a front mat, a center mat and a rear mat; a support frame for supporting part of said rear mat and center mat; and a movable storage container which supports the rest of said center mat and most of said front mat; wherein one end of said rear mat and one end of said center mat are foldably connected, and a front end of said rear mat is supported so as to be rotatable up and down by a front of said support frame, an other end of said center mat is supported so as to be rotatable up and down by said movable storage container, and one end of said front mat is supported so as to be rotatable up and down by said movable storage container, and by employing a construction wherein said movable storage container is stored within said support frame, when said movable storage container is stored within said support frame, said rear mat and center mat fold into an inverse V-shape to form a backrest, and said front mat becomes a seat thus forming the sofa, and when said movable container is pulled out from within said support frame, said front mat, center mat and rear mat become a continuous flat surface thus forming the mat section.

2. A folding sofa bed according to claim 1, further comprising a handle for opening the center mat and the rear mat.

3. A folding sofa bed according to claim 1, wherein wheels are provided on four corners of the bottom of said movable storage container, and rails for guiding said wheels are provided on the bottom of both sides of said support frame, and said movable storage container is movable by moving said wheels on the four corners of the bottom of said movable container back and forth upon said rails.

4. A folding sofa bed according to claim 1, wherein a support portion of the rear mat of said mat section supported on said support frame, a junction between said rear mat and said center mat, a support portion of the rear mat supported on said movable storage container, and a support portion of the front mat supported on said movable storage container are each connected or supported using spring loaded buffers.

5. A folding sofa bed according to claim 1, further comprising a buckle for latching together the center mat and the rear mat which form the backrest.

6. A folding sofa bed according to claim 1, wherein the total length of said movable container is approximately half the length of the bed.

7. A folding sofa bed according to claim 1, wherein when used as a sofa, said front mat is supported by said movable storage container in such a way that said front mat can open upward from the front of the sofa.

8. A folding sofa bed according to claim 1, wherein the support frame is provided with a side panel spacer which maintains slidability with the movable storage container.

9. A folding sofa bed according to claim 1, further comprising a pull handle which is mounted to a front panel of the movable storage container.

10. A folding sofa bed, comprising: a mat section divided lengthwise into at least three parts, namely a front mat, a center mat and a rear mat; a support frame for supporting part of said rear mat and center mat; and a movable storage container which supports the rest of said center mat and most of said front mat; wherein one end of said rear mat and one end of said center mat are foldably connected, and a front end of said rear mat is supported so as to be rotatable up and down by a front of said support frame, an other end of said center mat is supported so as to be rotatable up and down by said movable storage container, and one end of said front mat is supported so as to be rotatable up and down by said movable storage container, and by employing a construction wherein said movable storage container is stored within said support frame, when said movable storage container is stored within said support frame, said rear mat and center mat fold into an inverse V-shape to form a backrest, and said front mat becomes a seat thus forming the sofa, and when said movable container is pulled out from within said support frame, said front mat, center mat and rear mat become a continuous flat surface thus forming the mat section; and wherein the construction is such that when in bed form, approximately half of said center mat is supported by said support frame, and the remainder of said center mat is supported by said movable storage container.

11. A folding sofa bed comprising: a mat section divided lengthwise into at least three parts, namely a front mat, a center mat and a rear mat; a support frame for supporting part of said rear mat and center mat; and a movable storage container which supports the rest of said center mat and most of said front mat; wherein one end of said rear mat and one end of said center mat are foldably connected, and a front end of said rear mat is supported so as to be rotatable up and down by a front of said support frame, an other end of said center mat is supported so as to be rotatable up and down by said movable storage container, and one end of said front mat is supported so as to be rotatable up and down by said movable storage container, and by employing a construction wherein said movable storage container is stored within said support frame, when said movable storage container is stored within said support frame, said rear mat and center mat fold into an inverse V-shape to form a backrest, and said front mat becomes a seat thus forming the sofa, and when said movable container is pulled out from within said support frame, said front mat, center mat and rear mat become a continuous flat surface thus forming the mat section; and wherein a removable connector is used at the junction connecting the rear mat and the center mat of said mat section.

* * * * *